United States Patent [19]

Dufresne et al.

[11] Patent Number: 4,830,217

[45] Date of Patent: May 16, 1989

[54] BODY FLUID SAMPLE COLLECTION TUBE ASSEMBLY

[75] Inventors: Christopher M. Dufresne, Tappan, N.Y.; Andrzej J. Plucinski, Norwood; Casmir P. Nalezny, Paramus, both of N.J.

[73] Assignee: Becton, Dickinson and Company, Franklin Lakes, N.J.

[21] Appl. No.: 158,192

[22] Filed: Feb. 19, 1988

[51] Int. Cl.[4] ..... B65D 41/30

[52] U.S. Cl. ..... 220/420; 220/430; 215/12.1

[58] Field of Search ..... 215/12.1, 2.2, 247, 215/12.2; 220/415, 425, 430, 420

[56] References Cited

U.S. PATENT DOCUMENTS

| | | | |
|---|---|---|---|
| 2,493,380 | 1/1950 | Bailey | 215/12.1 X |
| 3,096,897 | 7/1963 | Hansen | 215/12.2 |
| 3,156,279 | 11/1964 | Grebowiec et al. | 215/12.1 X |
| 3,638,820 | 2/1972 | Misu | 215/12.2 |
| 3,845,873 | 11/1974 | Bridges | 215/12.2 |
| 3,955,020 | 5/1976 | Cavanagh et al. . | |
| 4,054,208 | 10/1977 | Lowe | 215/12.1 X |
| 4,138,026 | 2/1979 | Conklin . | |
| 4,399,919 | 8/1983 | Posnansky et al. | 215/12.2 |
| 4,429,798 | 2/1984 | Borows | 215/12.1 |
| 4,463,861 | 8/1984 | Tsubone et al. . | |
| 4,560,075 | 12/1985 | Lu | 215/12.2 |
| 4,625,884 | 12/1986 | Zimmermann | 215/12.1 X |
| 4,646,925 | 3/1987 | Nohara | 215/12.2 X |

*Primary Examiner*—Frankie L. Stinson
*Attorney, Agent, or Firm*—Robert P. Grindle

[57] ABSTRACT

An assembly is provided for receiving, maintaining and storing blood samples taken from individuals some of whom may have a disease which can contaminate anyone handling the sample. The assembly includes a glass tube which may be evacuated for facilitating and receiving a blood sample coaxially retained within a plastic tube which retains the sample and the general integrity of the assembly in the event that the glass tube cracks or breaks during handling. Thus, the glass tube maintains a long shelf-life for the evacuated tube, and does not react adversely or interfere with blood chemistries, while the outer plastic sleeve protects the user from broken glass and/or contamination. A special interlock ring holds the glass tube coaxially in place relative to the plastic tube.

6 Claims, 1 Drawing Sheet

BODY FLUID SAMPLE COLLECTION TUBE ASSEMBLY

BACKGROUND AND STATEMENT OF THE INVENTION

This invention relates to containers for receiving body fluid samples, and for containing those samples for subsequent examination to determine the presence or absence of disease in the samples. Generally speaking, such containers are in tube form and they may or may not be evacuated, depending upon the particular sample being taken. As will be understood by practitioners-in-the-art, evacuated tubes are used in great numbers for taking blood samples with the tubes frequently containing reagents for reacting with the blood samples for determining the presence or absence of disease.

The tubes may also be non-evacuated tubes for taking samples for one reason or another. Of course urine samples may also be taken in both evacuated and non-evacuated tubes. While non-evacuated tubes are utilized in great numbers, it is preferred to use evacuated tubes for many specific applications for maintaining a seal of the tube prior to use and for facilitating the entry of the sample into the evacuated tube for subsequent testing of the sample.

For evacuated tubes, in particular, it is important to maintain the vacuum over a period of time in order to provide appropriate storage life for those tubes prior to their being used. That is, it is important for the vacuum level to be maintained for a period of time prior to the time when a technician or a nurse uses the tube for receiving a blood sample, for example.

Many developments have been made in the past in order to provide plastic tubes for evacuated tube applications. However, plastic tubes have not been developed to the extent where they will maintain an appropriate vacuum for a period of time long enough to be satisfactory for a shelf-life which is appropriate under the circumstances in which such tubes are used. Moreover, various plastics have a tendency, in certain applications, to react adversely or interfere with blood chemistries, subsequently, during the actual testing of the sample in a lab. In some instances, the plastic may interfere with reactants contained in the tube for the purpose of reacting with a blood sample, for example, in order to provide an appropriate test result during examination.

Therefore, it is appropriate and conventional for tubes to be comprised of glass for use in evacuated tubes because glass maintains the vacuum for a much longer or indefinite period of time, and glass does not react adversely in most cases with any blood chemistry applications utilizing such tubes.

The difficulty, on the other hand, with the use of glass tubes is breakage. With the advent of the highly contagious AIDS virus in many people, it has become extremely important to avoid contamination of technicians, nurses and doctors by blood samples obtained by them from diseased patients.

As will be understood, glass tubes break and/or they may be cracked by being struck, inadvertently, against some object during the course of the taking of a sample or the course of the sample being delivered from a patient to the laboratory for subsequent testing. It will be understood, further, that such breakage and/or cracking may result in leakage of a diseased blood sample, for example, over the hands of the technician or the person taking the sample or the laboratory technician who is in the course of examining the sample for the presence of disease.

If that technician happens to have an open wound, the possibility of acquiring the AIDS virus or some other disease such as hepatitis, is substantial. Also, broken glass may cut and contaminate, and the pieces must be handled in order to be disposed of. Accordingly, great pains are being taken in the development of any materials utilized for taking and handling samples which contain diseases of this kind and it is to this situation to which this invention is particularly directed.

The invention here utilizes a clear transparent plastic tube configured to receive coaxially therein a clear transparent glass tube. The bottom curved internal surface of the plastic tube may contain ribs integral with the bottom surface of the plastic tube in order to stabilize and maintain the glass tube inserted therein in a coaxial position therewith. Subsequent to insertion of the glass tube within the plastic tube of the assembly of the invention herein, an interlock ring specifically arranged to maintain the coaxial positioning of the outer plastic tube with the inner glass tube is placed adjacent the top edge of the plastic and glass tubes. The interlock ring is specifically configured in order to maintain the integrity of this coaxial positioning and to provide appropriate stability for the assembly of the invention.

In addition, the ring includes an integral annular internal flap which "gives" during insertion of the glass tube into the plastic ring so as to frictionally grip the glass tube and hold it coaxially in place within the plastic tube. Thus, by having the entire outer surface of the glass tube covered by a plastic tube, if the glass tube is broken or cracked, in the kind of accident discussed above. The plastic tube around the glass tube contains the sample therein. Even though the sample may not be utilized for subsequent testing for the presence of disease because of the crack or break, at least the technician may contain the sample and dispose of it prior to any dripping or spilling and subsequent contamination. Also, the plastic tube shields the user from sharp broken edges and contains the shattered pieces of glass.

It will be understood that it makes no difference whether the glass tube is evacuated or not evacuated in accordance with this invention. The presence of this sleeve firmly attached to the outer surface of the glass container holding the sample has the effect of maintaining the general integrity of the container holding a sample so that it may be properly disposed of without any contamination to the user. In addition, the sleeve makes the container stronger over all because of the cushioning characteristics thereof.

As purely illustrative of a plastic sleeve material which may be used over a glass fluid specimen tube, in accordance herewith, one may note that the plastic sleeve or tube is preferably injection molded from a rigid thermoplastic material having high clarity and good impact resistance. Representative materials for this purpose include, for example, polyethylene terephthalate, styrene acrylonitrile, acrylonitrile-butadiene-styrene, polycarbonate, or other thermoplastic materials having the high clarity and good impact resistance required. The interlock ring utilized, in accordance herewith is comprised of a resilient material in order to develop "snap-lock" properties so that the ring may be snapped in place inside and around the top edge of the plastic sleeve, and may again be resiliently deformed for receiving the glass tube therein in order to hold the entire assembly in its desired coaxial position.

As a further feature of the invention, a curable filler or adhesive may be used along a portion of the adjacent opposed surfaces of the glass and plastic tubes particularly near the bottom closed ends thereof in order to maintain the two tubes fixed relative to each other in their desired coaxial position. Moreover, as discussed above, the internal bottom surface of the plastic tube may include integral ribs around the circumferential edge of the bottom internal surface for engaging the outer surface of the glass tube.

With the foregoing and additional objects in view, this invention will not be described in more detail and other objects and advantages thereof will be apparent from the following description, the accompanying drawings, and the appended claims.

As purely illustrative of an arrangement of container assembly which may be used for carrying out this invention, one may note the attached drawings in which a preferred embodiment of such a container is shown utilizing the coaxially arranged glass and plastic container assembly of the invention.

IN THE DRAWINGS

DETAILED DESCRIPTION OF THE INVENTION

Figure 1:
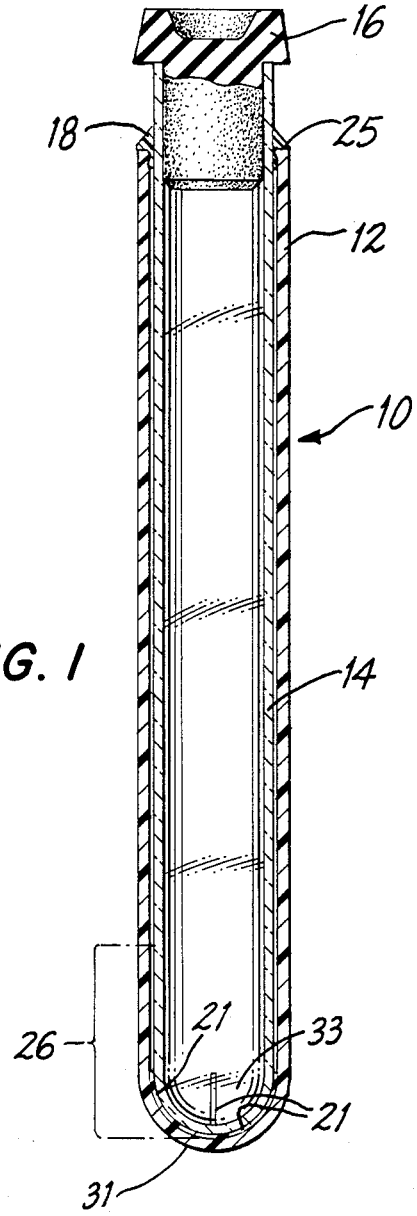
FIG. 1 is a longitudinal sectional view of a tube-shaped body fluid sample container assembly, illustrating the invention.

Referring to the drawings in which like reference characters refer to like parts throughout the several views thereof, FIG. 1 shows an assembly generally designated 10 including an outer clear plastic tube 12. Coaxially positioned within tube 12 is a clear glass tube 14. Positioned on the top edge of plastic tube 12 is an interlock ring 18. Received in the top of the glass tube 14 is an elastomer stopper 16 for sealing glass tube 14 and maintaining the vacuum in glass tube 14, if required. At any rate, elastomeric stopper 16 is a conventional stopper of the kind utilized in evacuated blood collection tubes. Also, stopper 16 may be used simply to maintain glass tube 14 sealed for subsequent use. Stopper 16 may be comprised of, for example, natural or synthetic rubber or a combination thereof. Also, stopper 16 may be enclosed in a plastic cap.

Figure 2:
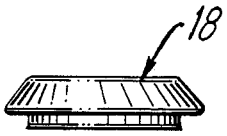
FIG. 2 is a side elevational view of the interlock ring of the invention.
Figure 3:
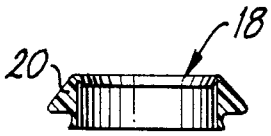
FIG. 3 is a cross-sectional view of the interlock ring of the invention.
Figure 4:
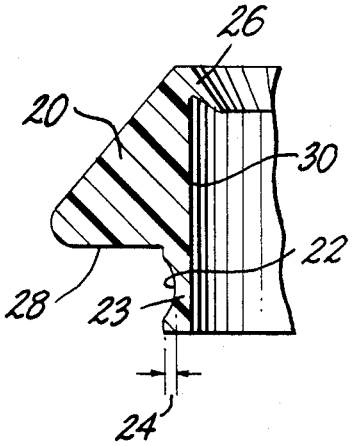
FIG. 4 is an enlarged sectional view of the annular overhang portion of the interlock ring of the invention.

FIGS. 2 and 3 show an enlarged view of ring 18 which serves for interlocking the glass and the plastic tube in a stabilized coaxial position as shown in FIG. 1. Interlock ring 18 includes an annular portion 20 which is shown in detail in FIG. 4. Annular overlap portion 20 of ring 18 includes an annular depending portion 23 which has a curved insert surface 22 for receiving the top rounded or beaded edge of plastic tube 12. The depth 24 of this curved portion 22 is about 0.005 inches. Thus, the top edge 25 of tube 12 has a rounded bead, which is conventional in plastic tubes of this kind, and is received within this radial annular insert 22 for holding the interlock ring 18 firmly in place on the top edge 25 of plastic tube 12. Moreover, the overhang surface 28 of annular overhang portion 20 rests upon the top edge 25 of plastic tube 12.

As shown on the upper internal surface 30 of annular ring 18, an integral flap 26 is positioned. This flap 26 is deformed downwardly and radially outward upon insertion of glass tube 14 through ring 18 in the assembly of the glass tube 14 within the plastic tube 12. This deformation has the effect of having the flap 26 surface frictionally engage and hold glass tube 14 within plastic tube 12 in the desired axial position.

Figure 5:
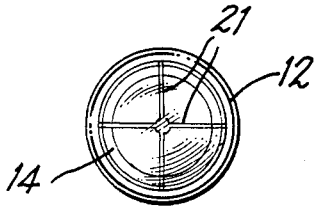
FIG. 5 is a bottom plan view of the assembly shown in FIG. 1.

Also positioned in the bottom internal surface of the closed end 31 of plastic tube 12 are a plurality of spaced apart ribs 21 (FIG. 5) integral with the internal surface of the closed end 31 of plastic tube 12. These ribs serve to seat and engage the bottom closed end 33 of glass tube 14. If desired, an adhesive may be used in the general area designated 22 in FIG. 1 between the outer surface of glass tube 14 and the inner surface of plastic tube 12 for adding increased stability and fixing the assembly of the invention so as to maintain the tubes in their desired coaxial position.

Representative adhesives for this purpose include ultraviolet radiation curable adhesives such as IMPRUV R, a product of Loctite Corporation, cyanoacrylate adhesives such as SUPERBONDER R, a product of Loctite Corporation. Other adhesives include heat curable adhesives such as UNISET R, a product of Amicon or an anaerobic adhesive, such as SPEEDBONDER R, a product of Loctite Corporation. A Preferred adhesive is the Loctite Product, IMPRUV R formulas 362, 365 or 366 which adhesives have indefinite fixing time to facilitate assembly. Formula 363 is particularly preferred because it has high clarity and will not interfere, therefore, with subsequent blood sample observation in the laboratory when the technician is viewing the results of the tests of the sample in the glass tube contained within the plastic tube of the invention.

Thus, as will be apparent from the foregoing, there are provided in accordance with this invention, safety containers for receiving and holding body fluid samples which may or may not contain disease. The arrangement herein of a plastic tube covering the entire glass container is particularly appropriate for evacuated containers since glass tubes may then be used without the danger of cracking and/or breaking the container while it contains a disease containing a body fluid sample. There is a substantial reduction in the possibility of contamination of the user under these circumstances.

It should be borne in mind that many blood sample tubes are subjected to centrifugal forces for separating a blood sample, for example, into its individual components. It is under these conditions, in some circumstances, that the glass tubes are broken flinging glass particles and blood sample within the centrifuge resulting in contamination of the equipment and possibly the environment. With this invention, this situation is obviated.

It will be understood that this invention provides a very useful and inexpensive approach to containing samples in glass containers, whether or not the containers are evacuated. Because of the tremendous concern with the spread of diseases such as hepatitis and AIDS, the arrangement herein is particularly useful for applications of the kind where the potential for spreading the disease is great, and particularly in obtaining blood samples in a series of evacuated tubes for subsequent transfer to a clinical lab for examination for the presence of such a disease.

While the particular arrangements of body fluid sample containers disclosed herein form a preferred embodiment of this invention, this invention is not limited to this particular embodiment and changes can be made therein without departing from the scope of the invention which is defined in the appended claims.

What is claimed is:

1. A composite sample container assembly for receiving and containing human fluid samples without leakage, characterized by (a) a plastic tube;

(b) said plastic tube having an open end and a closed end;

(c) said open end of said plastic tube defining the annular upper edge of said plastic tube;

(d) a glass tube inserted into said open end of said plastic tube so that said plastic tube and said glass tube are positioned coaxially relative to reach other;

(e) said glass tube having an open end and a closed end;

(f) an annular locking ring comprised of a resilient material snap-fit onto the said annular upper edge of said open end of said plastic tube;

(g) said locking ring including an integral annular resilient flap for frictionally engaging the outer surface of said glass tube adjacent the said open end of said glass tube;

(h) said annular locking ring including an annular depending portion;

(i) said annular depending portion having an annular outwardly facing surface; and (j) said annular outwardly facing surface having an annular radial insert surface for engaging said annular edge of said open end of said plastic tube in said snap-fit engagement.

2. The assembly of claim 1, further characterized by (a) a stopper positioned in the open end of said glass tube; and (b) said glass tube is evacuated.

3. The assembly of claim 1, further characterized by (a) a plurality of integral ribs extending from the internal surface of said closed end of said plastic tube;

(b) said ribs spaced circumferentially around said closed end of said plastic tube; and (c) the surface of said plurality of ribs for engaging the outer surface of said closed end of said glass tube for maintaining the coaxial relationship of said glass and plastic tubes.

4. The assembly of claim 1, further characterized by (a) adhesive applied to the internal surface of said plastic tube and the external surface of said glass tube adjacent the said closed ends of said plastic and glass tubes for maintaining the said coaxial positioning thereof.

5. A composite sample container assembly for receiving and containing human fluid samples without leakage, characterized by (a) a plastic tube;

(b) said plastic tube having an open end and a closed end;

(c) said open end defining the annular upper edge of said plastic tube;

(d) said plastic tube for receiving a glass tube in the said open end thereof;

(e) an annular locking ring comprised of a resilient material snap-fit onto the annular upper edge of said open end of said plastic tube;

(f) said locking ring including an integral annular resilient flap for frictionally engaging the outer surface of a glass tube inserted into said plastic tube;

(g) said annular locking ring including an annular depending portion;

(h) said annular depending portion having an annular outwardly facing surface; and (i) said annular outwardly facing surface having an annular radial insert surface for engaging said annular edge of said open end of said plastic tube in said snap-fit engagement.

6. The assembly of claim 5, further characterized by (a) a plurality of integral ribs extending from the internal surface of said closed end of said plastic tube;

(b) said ribs spaced circumferentially around said closed end of said plastic tube; and (c) the surface of said plurality of ribs for engaging the outer surface of the closed end of a glass tube inserted into said plastic tube for maintaining the coaxial relationship of a glass tube inserted into said plastic tube.

* * * * *